US007854628B2

(12) United States Patent
Chazottes et al.

(10) Patent No.: US 7,854,628 B2
(45) Date of Patent: Dec. 21, 2010

(54) SEALED ELECTRICAL CONNECTOR

(75) Inventors: Frédéric Chazottes, Houx (FR); Michel Aeschbacher, Saint-Prest (FR)

(73) Assignee: FCI, Versailles (FR)

( * ) Notice: Subject to any disclaimer, the term of this patent is extended or adjusted under 35 U.S.C. 154(b) by 0 days.

(21) Appl. No.: 12/225,523

(22) PCT Filed: Mar. 22, 2006

(86) PCT No.: PCT/EP2006/003684

§ 371 (c)(1),
(2), (4) Date: Jan. 27, 2009

(87) PCT Pub. No.: WO2007/107175

PCT Pub. Date: Sep. 27, 2007

(65) Prior Publication Data

US 2009/0215298 A1 Aug. 27, 2009

(51) Int. Cl.
*H01R 15/82* (2006.01)

(52) U.S. Cl. ..... 439/587

(58) Field of Classification Search ..... 439/589, 439/587, 274, 275, 595

See application file for complete search history.

(56) References Cited

U.S. PATENT DOCUMENTS

| | | | | |
|---|---|---|---|---|
| 4,944,688 | A * | 7/1990 | Lundergan | 439/275 |
| 4,998,896 | A | 3/1991 | Lundergan | 439/595 |
| 5,538,441 | A * | 7/1996 | Paolucci et al. | 439/589 |
| 5,707,251 | A | 1/1998 | Sakai et al. | 439/589 |
| 6,176,739 | B1 * | 1/2001 | Denlinger et al. | 439/589 |

FOREIGN PATENT DOCUMENTS

| | | |
|---|---|---|
| FR | 2 797 718 | 2/2001 |

* cited by examiner

*Primary Examiner*—Alexander Gilman
(74) *Attorney, Agent, or Firm*—Harrington & Smith

(57) ABSTRACT

This connector includes an insulative housing having a plurality of terminal accommodating chambers, a grommet formed with a plurality of cable passages, a grid having a plurality of passages in correspondence with the passages and a closing member mounted at the rear side of the grid for selectively closing the passage to a first predetermined group of chambers, said closing member including a plate, which is formed with through-holes in correspondence with a second predetermined group of chambers. The closing member further includes at least one plug projecting from the plate in correspondence with the first group of chambers, said plugs being provided to be inserted in the respective passages of the seal, and thus sealingly close said passages.

14 Claims, 3 Drawing Sheets

SEALED ELECTRICAL CONNECTOR

BACKGROUND OF THE INVENTION

The invention relates to an electrical connector comprising an insulative housing having a front mating face and a plurality of terminal accommodating chambers with an open rear end for the insertion of the respective terminal, a grommet-type seal formed with a plurality of cable passages in correspondence with the chambers and arranged in said housing at the rear end of the chambers, a grid attached within the housing at the rear side of the seal for maintaining the seal in the housing and for guiding cables, said grid having a plurality of passages in correspondence with the passages of the seal, and a closing member mounted at the rear side of the grid for selectively closing the passage to a first predetermined group of chambers, said closing member comprising a plate, which is formed with through-holes in correspondence with a second predetermined group of chambers, said second group being complementary to the first group.

Prior art connectors of this type are known for example from FR 2 866 485.

In such connectors, the plate is selectively pierced to be formed with the through-holes corresponding to the chambers to be engaged by a terminal in the selected wiring configuration. The passages to the unoccupied chambers are closed at the rear end of the grid, but generally remain open in the section of the grommet.

This may cause a loss of sealing performances.

SUMMARY OF THE INVENTION

It is an object of the invention to overcome this problem and provide an electrical connector of the above type with improved sealing performances.

Accordingly, the invention provides an electrical connector of the above-mentioned type, wherein the closing member further comprises plugs projecting from the plate in correspondence with the first group of chambers, said plugs being provided to be inserted in the respective passages of the seal, and thus sealingly close said passages.

The invention relates to a process for manufacturing the closing member of an electrical connector as described above, said process comprising the following successive steps:

manufacturing an intermediate standard closing member, which comprises a solid plate and a number of projecting plugs corresponding to all the chambers of the housing, and stamping said intermediate standard closing member in order to selectively remove plugs and form through-holes in correspondence with the second predetermined group of chambers to be opened for a respective connector configuration.

The invention also relates to an intermediate standard closing member as described above, which comprises a solid plate and an array of fingers, all of said fingers having substantially the same length and substantially perpendicularly projecting from the plate in the same direction.

The invention will be better understood on reading the following description of one particular embodiment of the invention, given as a non-limiting example.

DETAILED DESCRIPTION OF ONE PREFERRED EMBODIMENT

Figure 1:
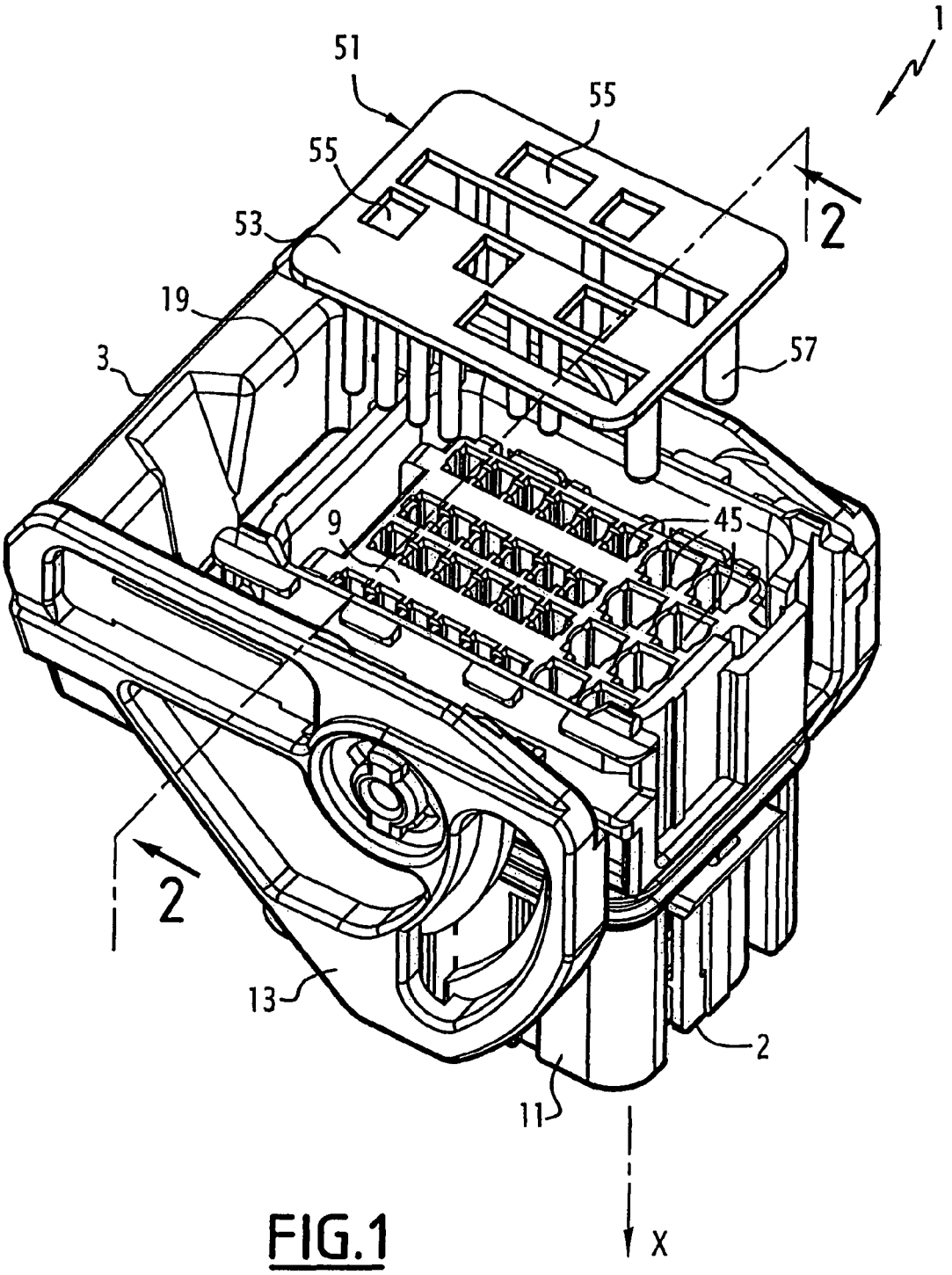
FIG. 1 is a partially exploded perspective view, from the rear side, of an electrical connector of the invention.
Figure 2:
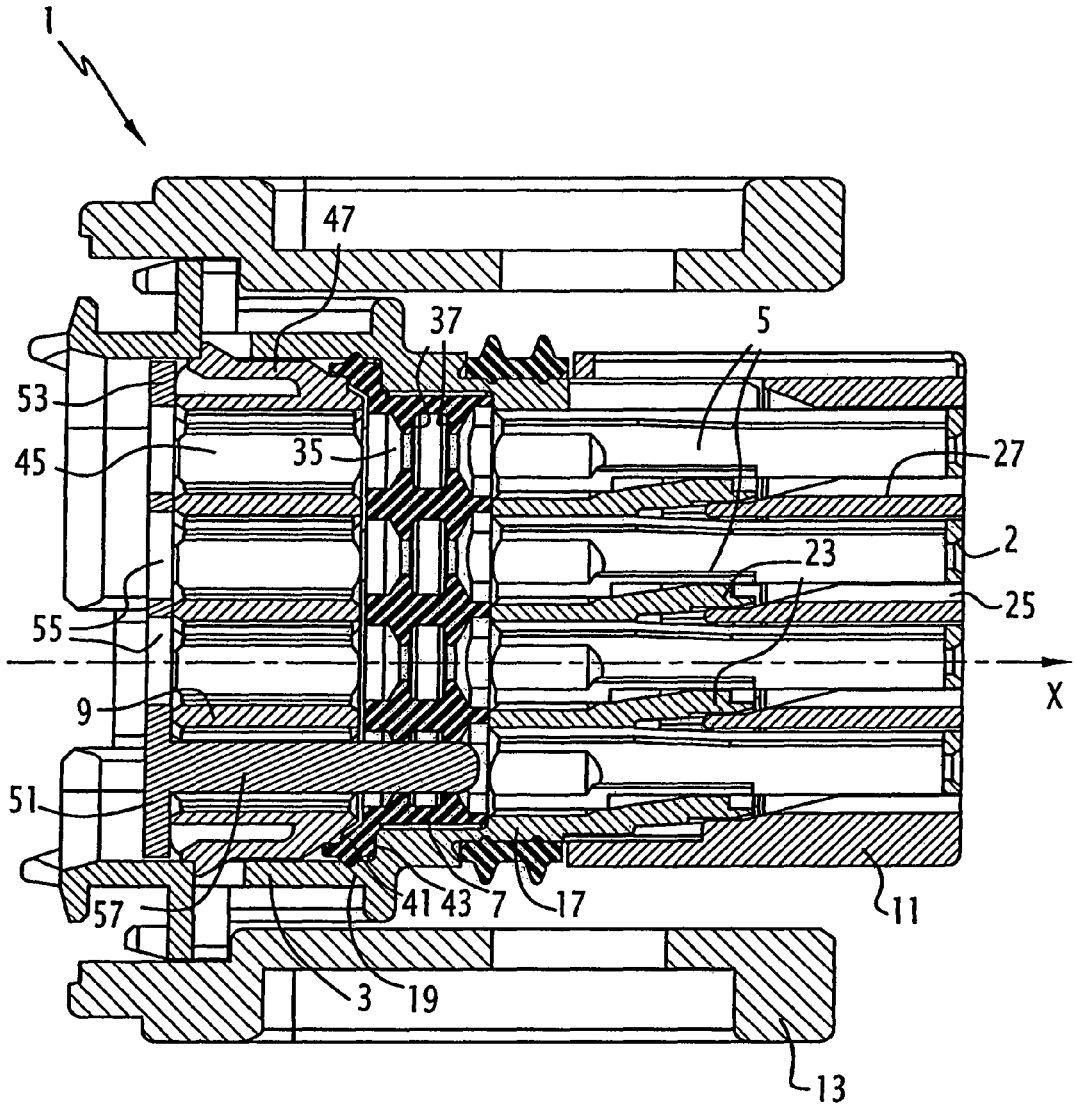
FIG. 2 is a sectional view, in an axial plane along the 2-2 direction, of the connector of FIG. 1 with the closing member fixed within the housing.

A connector 1 according to the invention is shown on FIGS. 1 and 2.

In the example shown, the connector 1 is a male connector of a type used in an automotive application, suitable to mate with a header-type complementary female connector, such as a header of an Electronic Calculation Unit. However, the invention may apply to a large number of different connector types.

For the sake of clarity, the Figures are orientated according to an X-axis, which represents the mating direction of the connector 1 with the header (not shown). The X-axis is supposed to be orientated from the connector 1 towards the header in mating conditions.

Every direction- or orientation-related term in the following description, in particular the terms "rear" and "front", should be interpreted as referring to this axis.

In this respect, the connector 1 has a front face 2 corresponding to the mating side.

As shown on FIGS. 1 and 2, the connector 1 has an insulative housing 3 made of a plastic material and formed with a plurality of terminal accommodating chambers 5, a grommet-seal 7 and a grid 9 for guiding the cables attached to the terminals.

The connector 1 also comprises a secondary locking member 11, for securing the terminals in their accommodated position in the respective chambers, and a U-shaped locking lever 13 for securing the connector 1 on the complementary header in the mated position. The lever 13 is pivotally mounted on the housing 3.

The housing 3 is essentially constituted of a front parallelepiped-shaped section 17, which is formed with axial passages defining the chambers 5, and a rear skirt 19 on which the passages rearwards open. The front section 17 has a front end face which defines the front face 2 of the connector 1.

The front section 17 has walls defining the chambers 5, wherein resilient arms 23 are formed. Said arms 23 are provided to snap-fit with respective terminals accommodated in the chambers 5, thereby securing the terminals within the chambers.

The secondary locking member 11 is formed as a cap, which is, in the operative position, engaged from the front side on the peripheral walls of the front section 17. The secondary locking member 11 has a front plate 25 and fingers 27 rearwards projecting from said plate. In the operative position of the locking member 11, the fingers 27 engage the respective arms 23, thereby preventing the arms from deflecting and disengage from the respective terminals. The locking member 11 and the front section 17 are provided with complementary securing means (not shown) for securing the locking member 11 on the front section 17 in the active position.

The grommet 7 is essentially made of one parallelepiped-shaped elastomeric piece, with through passages 35 formed therein. The passages 35 extend from a rear side to a front side of the grommet 7 and correspond to the passages defining the chambers 5, the passages 35 being aligned with the chambers 5 when the grommet 7 is mounted within the housing 3.

The passages 35 are designed to allow the insertion of the terminals, from the rear side of the housing 3, into the respective chambers 5, and to ensure the sealing of the chambers around the cables.

For the sake of clarity of the drawings, the terminals and cables are not shown.

In order to ensure the sealing effect at the rear side around the cables, the grommet 7 has a pair of annular lips 37 in each passage 35, said lips being axially offset and each defining a narrow section in the respective passage.

The grommet 7 is mounted in the skirt 19, with the front face thereof bearing on the rear face of the front section 17. The peripheral surfaces of the grommet 7 bear on the internal surfaces of the skirt 19, thereby providing a sealed interface.

The grommet 7 is formed with a rear flange 41 which axially bears on a corresponding internal flange 43 of the skirt 19.

The grid 9 is made of one parallelepiped-shaped moulded piece, having through-passages 45 corresponding to the respective passages 35 of the grommet 7. Said passages 45 axially extend from the rear face to the front side of the grid.

As visible on FIG. 2, the grid 9 comprises snap-fit means 47 for securing the grid within the skirt 19, said means being under the form of resilient arms provided with a hook.

The grid 9 is axially fit mounted within the skirt 19 at the rear side of the grommet 7. The grid 9 bears on the rear side of the grommet 7, thereby axially retaining the latter in the housing and providing a slight axial compression of the grommet.

In addition, the grid 9 functions as a guide for the cables, for maintaining the end section of the cables which is connected to the terminals in an axial orientation. The grid 9 thus prevents the passages 35 of the grommet from being deformed in flexion, such a deformation causing a loss of sealing performance.

In general, the connector 1 further comprises an insulative cap (not shown) attached to the housing 3 at the rear side thereof. Said cap is suitable to close the rear side of the housing and guide the cables bundle.

In the partly assembled conditions shown on FIGS. 1 and 2, prior to the insertion of the terminals in the chambers 5, the grid passages 45 are axially aligned with the respective grommet passages 35 and with the respective chambers 5.

The connector 1 further comprises a closing member 51, which is preferably one-piece made of a moulded plastic material, mounted at the rear side of the grid 9.

The closing member 51 includes a rigid plate 53, which is formed with a plurality of through-holes 55 in correspondence (axially aligned) with a predetermined group of chambers 5. The closing member 51 further includes at least one plug 57 perpendicularly projecting from one side of the plate 53 in correspondence with the remaining chambers 5 of the connector.

The plugs 57 are all made as fingers having a substantial cylindrical shape and all preferably having the same length.

The connector 1 is further provided with snap-fit means (not shown) for securing the closing member 51 within the skirt 19, in the operative position (shown on FIG. 2) where the plate 53 axially bears on the rear side of the grid 9.

In this operative position, the closing member 51 selectively leaves the passages 35, 45 opened to the chambers 5 of the predetermined group and closes the passages 35, 45 to the remaining chambers 5. More precisely, the plugs 57 sealingly engage and close the respective passages 35 of the grommet 7 through the grid 9.

The provision of the closing member 51 thus makes it possible to sealingly close the passages corresponding to the unoccupied chambers 5, while leaving the passages opened only to the chambers to be engaged by a terminal, in view of inserting the terminals. The closing member 51 constitutes a screen preventing an erroneous insertion of a terminal into a chamber to be left unoccupied.

It should be appreciated that the closing member 51 could be defined as programmable, since it can be manufactured with different features related to the location of the holes 55 and plugs 57, depending on the wiring configuration of the connector 1 to be equipped therewith.

Figure 3:
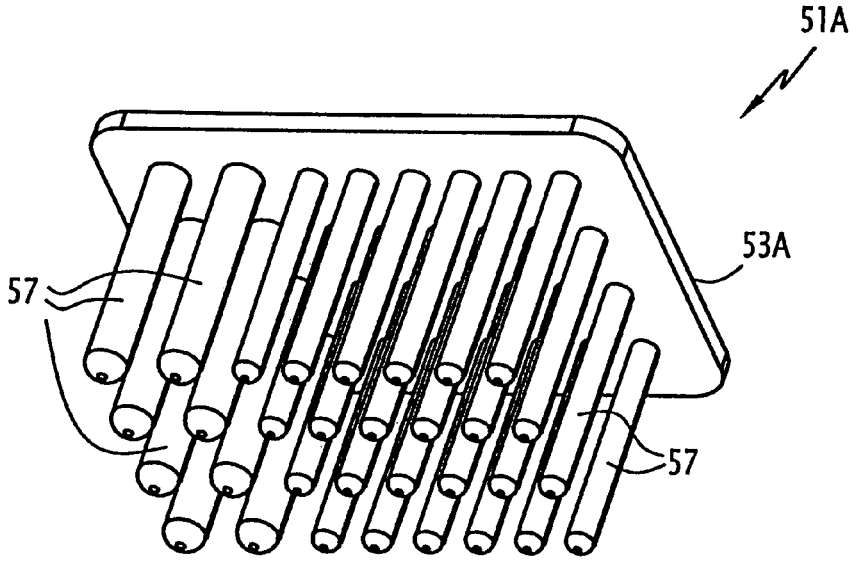
FIG. 3 is a perspective view of a standard intermediate closing member, illustrating a first step of the manufacturing process of a closing member for the connector of FIG. 1.
Figure 4:
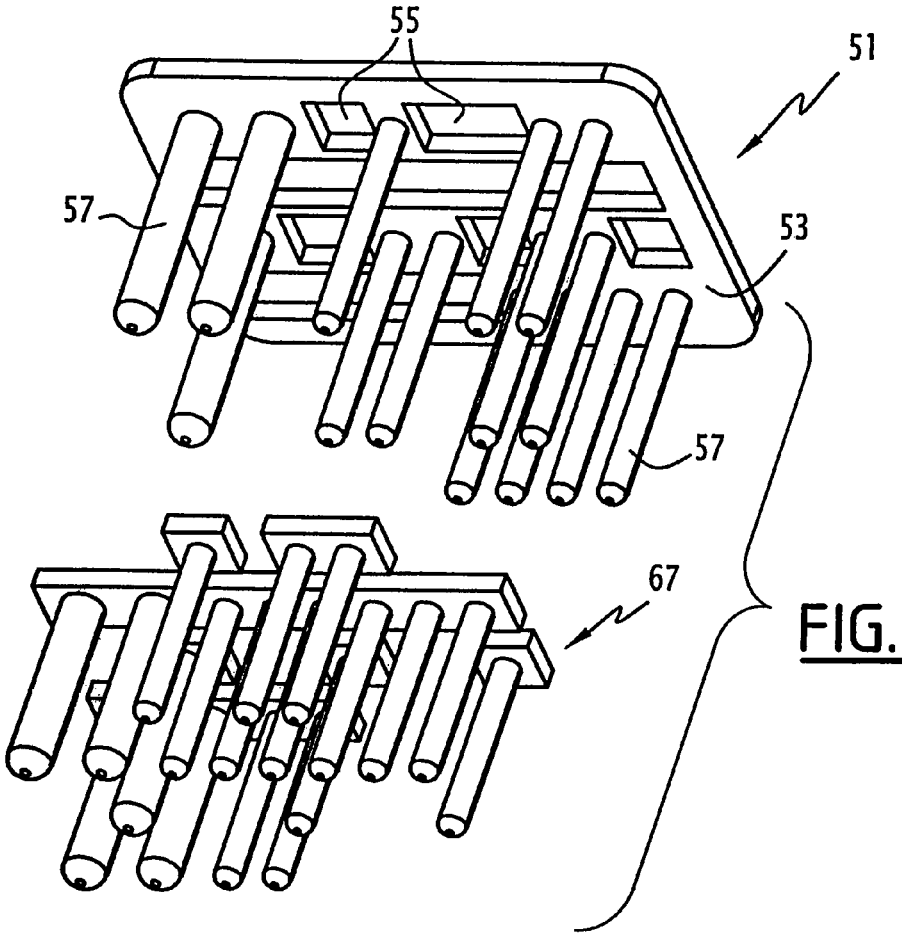
FIG. 4 is a perspective view illustrating a second step of the manufacturing process of a closing member for the connector of FIG. 1.

With reference to FIGS. 3 and 4, a preferred embodiment of the manufacturing process of the closing member 21 will now be described.

In a first step of the process, an intermediate standard closing member 51A (FIG. 3) is integrally made, preferably by injection moulding of a plastic material.

This intermediate member 51A comprises a solid plate 53A and an array of projecting plugs 57 corresponding to all the chambers 5 of the housing 3 to be equipped. At this stage, the plate 53A does not have any through-hole as inlet for terminal. The intermediate member 53A is called "standard" since it fits the dimensions of the type of connector 1 to be equipped, but it is not adapted to a specific wiring configuration taking into account the number and location of the ways to be equipped with a terminal.

In a subsequent step of the process, which is illustrated on FIG. 4, the intermediate standard closing member 51A is stamped in order to selectively remove plugs and form through-holes 55 in correspondence with the wiring configuration of the connector 1 to be equipped. In other words, through-holes 55 are formed and plugs are removed at the same locations on the plate 53, in correspondence with the chambers 5 wherein respective terminals have to be accommodated.

On FIG. 4, the removed plugs and plate pieces are commonly indicated with the reference number 67.

Such a process is suitable to minimize the costs involved in the manufacturing of the closing members, which costs may otherwise be very high due to the large number of possible wiring configurations for the same connector type. In the process described above, the intermediate members can be produced in very large series with the same relatively complex tool, while the stamping operation can be carried out with specific but relatively simple tools.

In addition, it is advantageous to make the grid and the closing member as separate parts, since it is thus made possible to protect the grommet during the transfer of the connector between the plant where it is manufactured and assembled, and the plant where the connector is wired.

The invention claimed is:

1. Electrical connector comprising an insulative housing having a front mating face and a plurality of terminal accommodating chambers with an open rear end for the insertion of the respective terminal, a grommet-type seal formed with a plurality of cable passages in correspondence with the chambers and arranged in said housing at the rear end of the chambers, a grid attached within the housing at the rear side of the seal for maintaining the seal in the housing and for guiding cables, said grid having a plurality of passages in correspondence with the passages of the seal, and a closing member mounted at the rear side of the grid for selectively closing the passage to a first predetermined group of chambers, said closing member comprising a plate, which is formed with through-holes in correspondence with a second predetermined group of chambers, said second group being complementary to the first group, characterized in that the closing member further comprises at least one plug projecting from the plate in correspondence with the first group of chambers, said plugs being provided to be inserted in the respective passages of the seal, and thus sealingly close said passages.

2. Electrical connector as claimed in claim 1, characterized in that it further comprises first snap-fit means for fixing the closing member within the housing.

3. Electrical connector as claimed in claim 1, characterized in that the closing member is made integral of a plastic material.

4. Electrical connector as claimed in claim 1, characterized in that the closing member is made integral by moulding and stamping.

5. Electrical connector as claimed in claim 1, characterized in that the plugs of the closing member are made as fingers, all of which having substantially the same length and substantially perpendicularly projecting from the plate in the same axial direction.

6. Electrical connector as claimed in claim 5, characterized in that the plugs are made as substantially cylindrical fingers.

7. Intermediate standard closing member for manufacturing a closing member of an electrical connector as claimed in claim 5 by a process for manufacturing the closing member of the electrical connector comprising the following successive steps:

manufacturing an intermediate standard closing member, which comprises a solid plate and a number of projecting plugs corresponding to all the chambers of the housing, and stamping said intermediate standard closing member in order to selectively remove plugs and form through-holes in correspondence with the second predetermined group of chambers to be opened for a respective connector configuration, characterized in that it comprises a solid plate and an array of fingers, all of said fingers having substantially the same length and substantially perpendicularly projecting from the plate in the same direction.

8. Electrical connector as claimed in claim 1, characterized in that the grid and the housing are provided with second snap-fit means for fixing the grid within the housing.

9. Process for manufacturing the closing member of an electrical connector as claimed in claim 1, comprising the following successive steps:

manufacturing an intermediate standard closing member, which comprises a solid plate and a number of projecting plugs corresponding to all the chambers of the housing, and stamping said intermediate standard closing member in order to selectively remove plugs and form through-holes in correspondence with the second predetermined group of chambers to be opened for a respective connector configuration.

10. Process as claimed in claim 9, wherein the step of manufacturing the intermediate standard closing member is made by integral moulding from a plastic material.

11. Electrical connector as claimed in claim 1 wherein a first one of said through-holes of said closing member is aligned with more than one of said chambers.

12. An electrical connector comprising:

a housing having a plurality of terminal accommodating chambers;

a grommet-type seal arranged in the housing at rear ends of the chambers, wherein the seal comprises a plurality of passages in correspondence with the chambers;

a grid attached to the housing and located at a rear side of the seal, wherein the grid maintains the seal in the housing and is adapted to guide cables, wherein the grid comprises a plurality of passages in correspondence with the passages of the seal; and a closing member located at a rear side of the grid, wherein the closing member closes passage to a first predetermined group of the chambers, wherein the closing member comprising a plate and at least one plug projecting from the plate, wherein the plate comprises through-holes in correspondence with a second predetermined group of chambers, wherein a first one of the through-holes is aligned with more than one of the chambers, wherein the at least one plug is in correspondence with the first group of chambers, and wherein the at least one plug is located in respective passages of the seal and sealingly close the respective passages of the seal.

13. A method comprising:

providing a housing having a plurality of terminal accommodating chambers;

locating a grommet-type seal in the housing at rear ends of the chambers, wherein the seal comprises a plurality of passages in correspondence with the chambers;

connecting a grid to the housing located at a rear side of the seal, wherein the grid maintains the seal in the housing and is adapted to guide cables, wherein the grid comprises a plurality of passages in correspondence with the passages of the seal; and connecting a closing member to the grid located at a rear side of the grid, wherein the closing member closes passage to a first predetermined group of the chambers, wherein the closing member comprising a plate and at least one plug projecting from the plate, wherein the plate comprises through-holes in correspondence with a second predetermined group of chambers, wherein a first one of the through-holes is aligned with more than one of the chambers, wherein the at least one plug is in correspondence with the first group of chambers, and wherein the at least one plug is located in respective passages of the seal and sealingly close the respective passages of the seal.

14. A method as in claim 13 further comprising manufacturing the closing member comprising:

manufacturing an intermediate standard closing member, which comprises a solid plate and a number of projecting plugs corresponding to all the chambers of the housing, and stamping the intermediate standard closing member in order to selectively remove plugs and form the through-holes in correspondence with the second predetermined group of chambers to be opened for a respective connector configuration.

* * * * *